US006668423B1

(12) United States Patent
Chen

(10) Patent No.: US 6,668,423 B1
(45) Date of Patent: Dec. 30, 2003

(54) CONTROL DEVICE OF A LUGGAGE PULL ROD

(76) Inventor: Shou Mao Chen, 344, Section 1, Chung Shan Rd., Tah-Cha Township, Taichung Hsien (TW)

( * ) Notice: Subject to any disclaimer, the term of this patent is extended or adjusted under 35 U.S.C. 154(b) by 0 days.

(21) Appl. No.: 10/174,807

(22) Filed: Jun. 20, 2002

(51) Int. Cl.[7] ..... B62B 1/00
(52) U.S. Cl. ..... 16/113.1; 16/405
(58) Field of Search ..... 16/113.1, 114.1, 16/405

(56) References Cited

U.S. PATENT DOCUMENTS 5,836,052 A * 11/1998 Chou ..... 16/405
5,875,520 A * 3/1999 Chang ..... 16/405
5,893,196 A * 4/1999 Tserng ..... 16/405
6,026,542 A * 2/2000 Lu ..... 16/113.1
6,026,543 A * 2/2000 Chen ..... 16/113.1
6,081,967 A * 7/2000 Chang ..... 16/113.1
6,128,806 A * 10/2000 Shou-Mao ..... 16/113.1
6,141,828 A * 11/2000 Kuo ..... 16/113.1
6,161,253 A * 12/2000 Tu ..... 16/113.1
6,226,834 B1 * 5/2001 Lu ..... 16/113.1

* cited by examiner

*Primary Examiner*—Anthony Knight
*Assistant Examiner*—Christopher J. Boswell
(74) *Attorney, Agent, or Firm*—Harrison & Egbert

(57) ABSTRACT

A luggage pull rod control device comprises a locating member in one end of a drive rod and an extension rod. The locating member is formed of a main body, a locating body, and a driven member.

3 Claims, 8 Drawing Sheets

CONTROL DEVICE OF A LUGGAGE PULL ROD

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to luggage, and more particularly to a pull rod control device of the luggage.

BACKGROUND OF THE INVENTION

The conventional luggage pull rod control device is generally formed of an elastic locating block and a receiving hole. The elastic locating block is located at one end of the expandable pull rod while the receiving hole is located at an appropriate position of the shank of the pull rod. In light of the mechanical friction between the wall of the receiving hole and the locating block, both the receiving hole and the locating block are worn out easily. As a result, the locating effect of the expandable pull rod is seriously undermined.

BRIEF SUMMARY OF THE INVENTION

The primary objective of the present invention is to provide a luggage pull rod control device comprising a locating member to locate effectively the expandable pull rod.

The features and the advantages of the present invention will be readily understood upon a thoughtful deliberation of the following detailed description of the present invention with reference to the accompanying drawings.

DETAILED DESCRIPTION OF THE INVENTION

Figure 1:
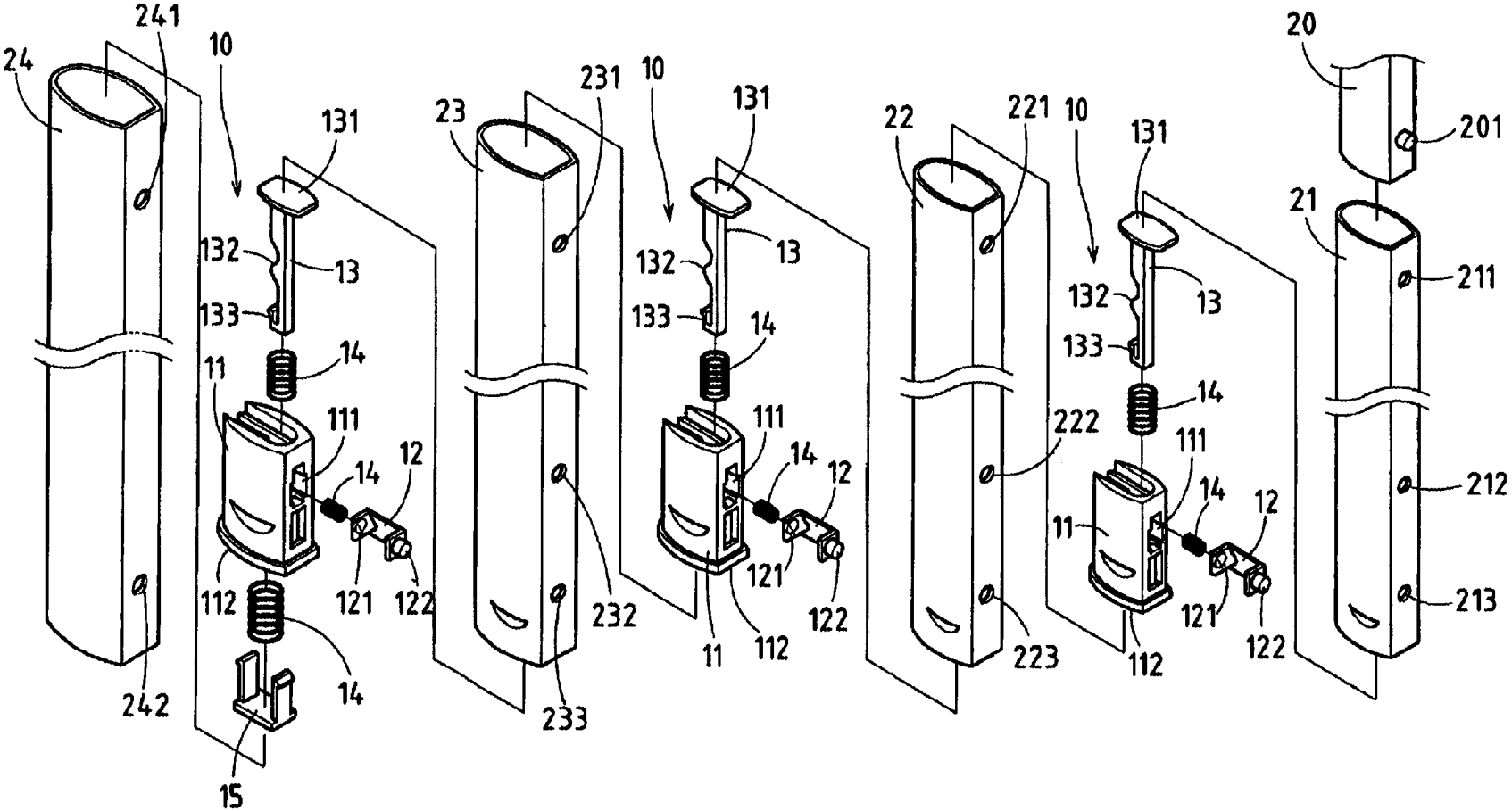
FIG. 1 shows an exploded view of the present invention.

As shown in all drawings provided herewith, a luggage pull rod control device of the present invention comprises a locating member 10 which is located in the interiors of a drive rod 20 and extension rods 21, 22, and 23. The drive rod 20, the extension rods 21, 22 and 23, and a fixation rod 24 form together an expandable pull rod which is applicable to a variety of luggages.

The locating member 10 comprises a main body 11, a locating body 12, and a driven member 13.

The main body 11 is provided in the interior with a receiving space, and in the side with an assembly hole 111, so as to join with the extension rods 21, 22, 23. The main body 11 is provided at the bottom with a press face 112.

The locating body is disposed in the assembly hole 111 of the main body 11 in conjunction with an elastic element 14 and is provided with a moving portion 121 and a locating portion 122 which is jutted out of the main body 11 to be corresponding with the through holes 211, 212, 213 of the extension rod 21, the through holes 221, 222, 223 of the extension rod 22, and the through holes 231, 232, of the extension rod 23, and the through holes 241 and 242 of the fixation rod 24.

The driven member 13 is of a rod-shaped construction and is provided at one end with a bearing end 131. The driven member 13 is provided in the shank with a guide portion 132, and at other end with a position confining portion 133 which is disposed in the main body 11 in conjunction with the elastic element 14. The guide portion 132 is cooperative with the moving portion 121 of the locating member 12.

By virtue of the displacement of the guide portion 132 of the driven member 13, the locating member 10 enables each rod member of the expandable pull rod to be located or adjusted.

The main body 11 is provided in the press face 112 with an elastic element 14 and a position confining member 15.

The drive rod 20, the extension rods 21, 22, 23, and the fixation rod 24 are different in diameter from one another.

Figure 2:
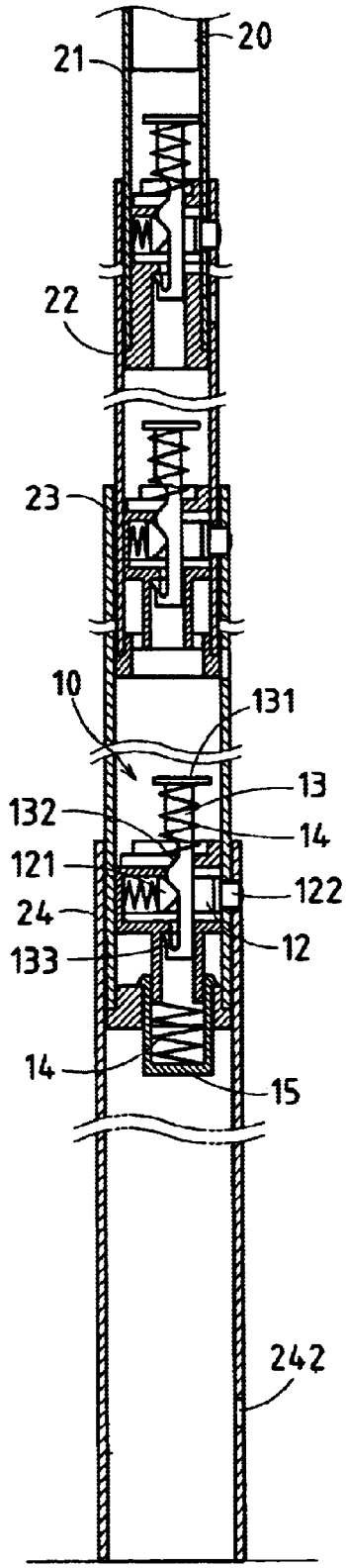
FIGS. 2–7 are sectional schematic views of the present invention in action.
Figure 3:
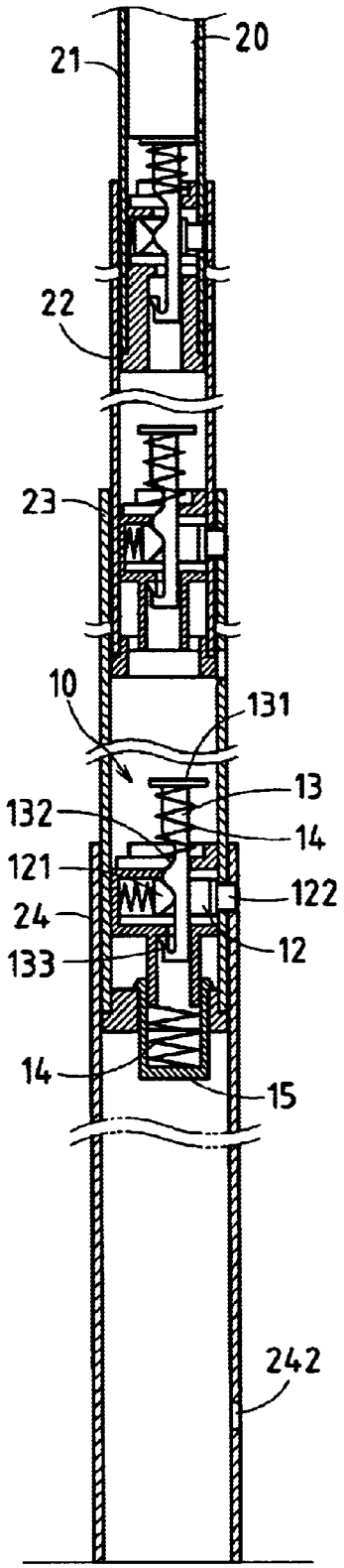
Figure 4:
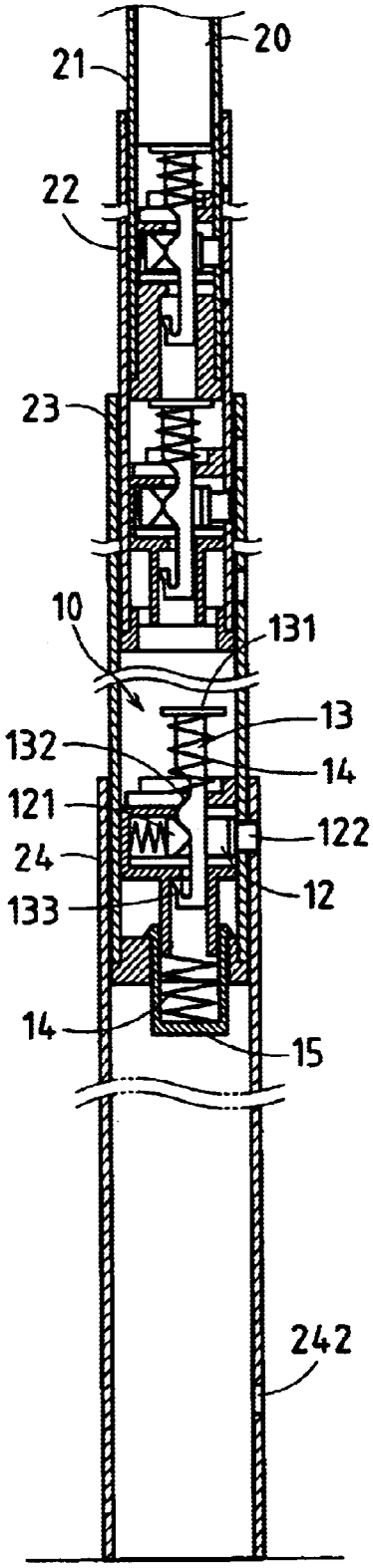
Figure 5:
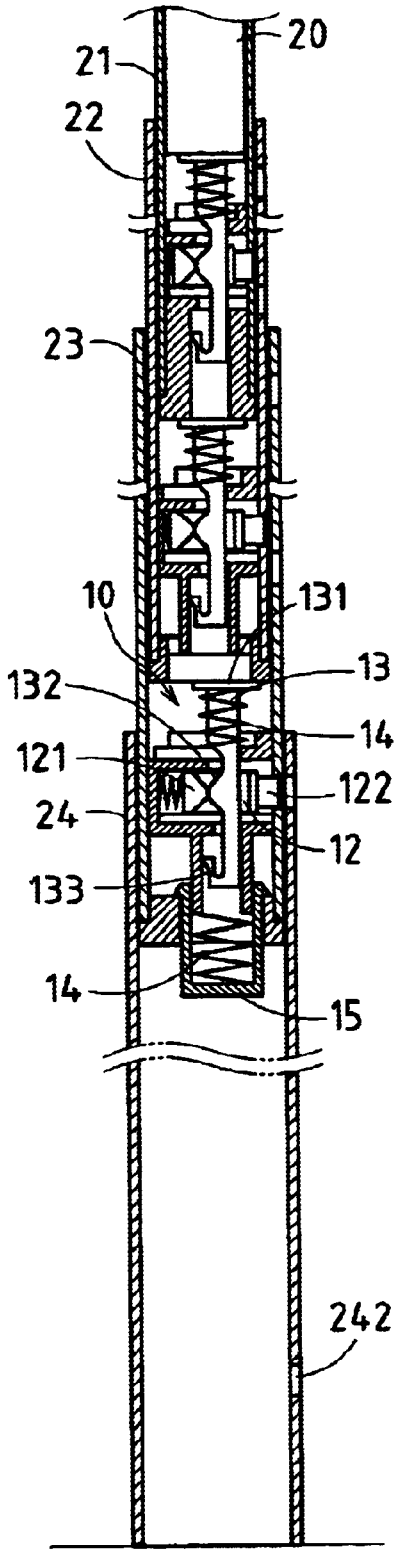
Figure 6:
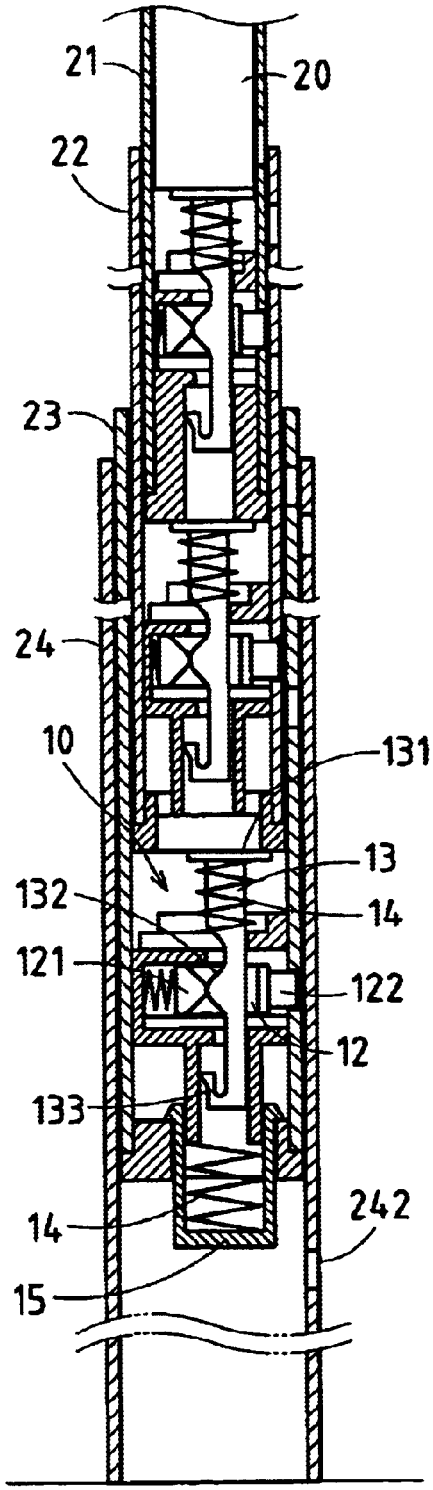
Figure 7:
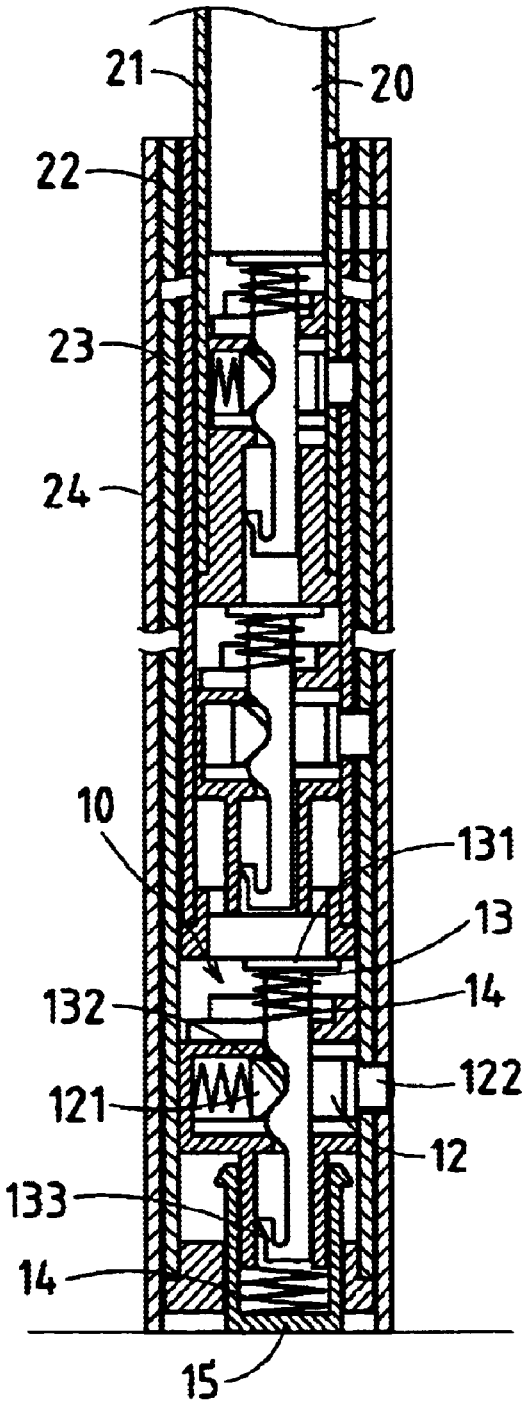
Figure 8:
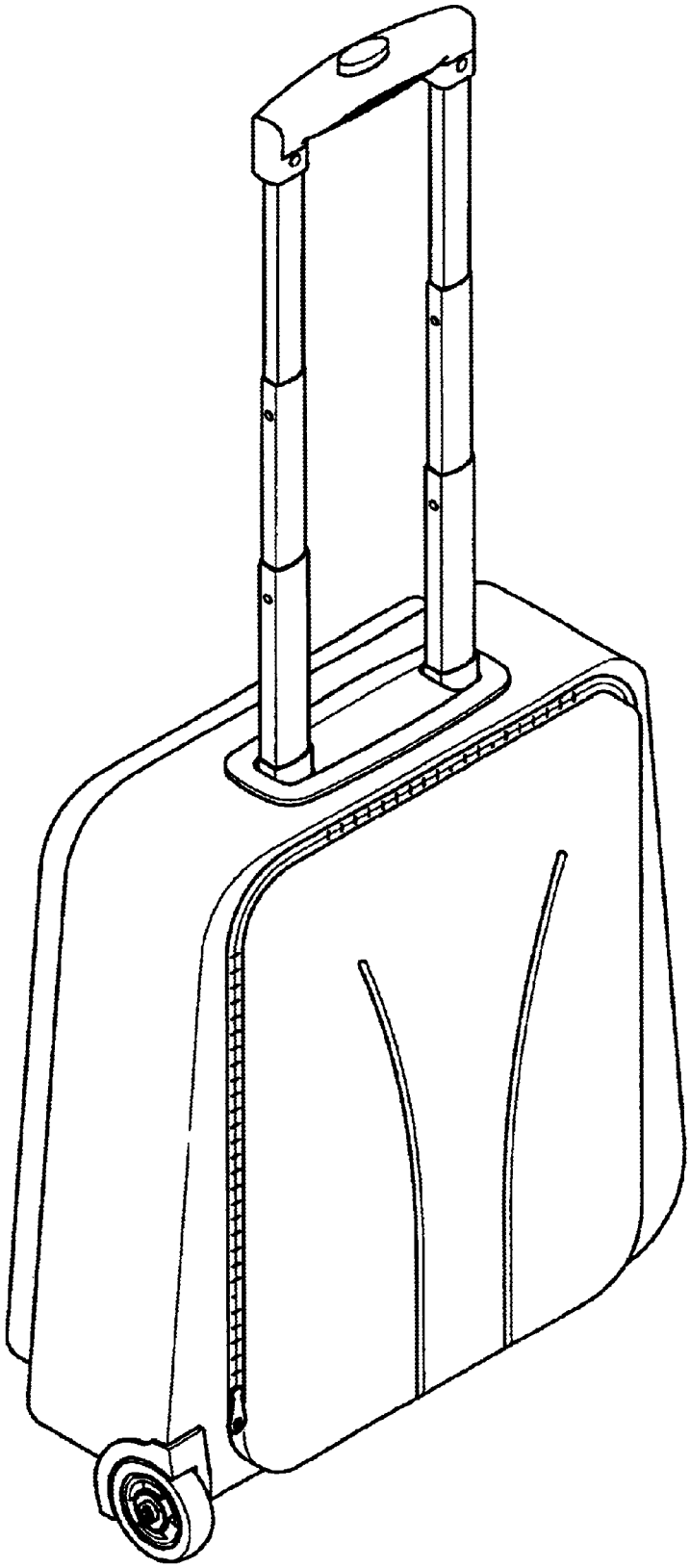
FIG. 8 shows a reference view of the present invention in use.

In operation, the locating portion 201 is caused by the drive rod 20 to move away from the through hole 211, as shown in FIG. 2, thereby enabling the drive rod 20 to press downward the locating member 10 which is located at the end of the extension rod 21, as shown in FIG. 3. As a result, bearing portion 131 of the driven member 13 is forced to link the guide portion 132 and the moving portion 121 of the locating member 12, thereby resulting in the withdrawal of the locating portion 122 from the through hole 221. The extension rod 21 and the drive rod 20 continue to press the locating member 10 which is located at the end of the extension rod 22. The process is repeated such that the extension rods 21, 22, 23 are received in the fixation rod 24, as shown in FIGS. 5–7.

The present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A luggage pull rod control device comprising:

a drive rod;

a locating member affixed within one end of said drive rod; and an extension rod slidably receiving said drive rod and said locating member therein, said locating member comprising:

a main body having a receiving space formed therein and an assembly hole communicating with said receiving space, said main body having a press face at a bottom thereof;

a locating body disposed in said assembly hole of said main body, said locating body having a generally U-shaped construction with a generally triangular-shaped surface on one face of said locating body and a locating protrusion extending outwardly from an oppoiste face of said locating body;

a first elastic element resiliently contacting said locating body so as to urge said locating protrusion outwardly of said assembly hole; and a driven member having a rod-shaped construction, said driven member having a bearing portion at one end thereof, said driven member having a shank extending downwardly from said bearing portion, said shank having a guide surface formed thereon, said driven member having a position confining portion at an end opposite said bearing portion, said driven member extending through said receiving space of said main body with a second eleastic element bearing against said bearing surface so as to urge said driving member outwardly of said receiving space, said triangular-shaped surface of said locating body contacting said guide surface of said shank so as to move said locating protrusion into and out of a hole of said drive rod and an aligned hole of said extension rod so as to selectively allow said drive rod to be fixed relative to said extension rod and to allow said drive rod to slide relative to said extension rod.

2. The device of claim 1, said press face of said main body having a position confining member affixed thereto, said position confining member having a third elastic element positioned therein.

3. The device of claim 1, said drive rod and said extension rod being of different diameters.

* * * * *